US006054027A

United States Patent [19]

Ebert

[11] Patent Number: 6,054,027

[45] Date of Patent: Apr. 25, 2000

[54] EDGE BRUSH FOR ELECTRODES

[76] Inventor: William Arthur Ebert, 15 E. Sahuaro, Tucson, Ariz. 85705

[21] Appl. No.: 09/131,124

[22] Filed: Aug. 7, 1998

Related U.S. Application Data

[63] Continuation-in-part of application No. 08/914,898, Aug. 20, 1997, Pat. No. 5,837,111

[60] Provisional application No. 60/027,921, Oct. 19, 1996, and provisional application No. 60/025,590, Sep. 4, 1996.

[51] Int. Cl.[7] ..... C25C 7/00; C25D 21/04

[52] U.S. Cl. ..... 204/267; 204/270; 204/278; 204/279; 204/280; 204/289

[58] Field of Search ..... 204/270, 278, 204/280, 279, 277, 289, 267; 205/94

[56] References Cited

U.S. PATENT DOCUMENTS

| | | | |
|---|---|---|---|
| 4,075,069 | 2/1978 | Shinohara et al. | 204/278 X |
| 4,668,353 | 5/1987 | Smith et al. | 204/278 X |
| 5,104,496 | 4/1992 | Dupree | 204/278 X |
| 5,470,445 | 11/1995 | Murray et al. | 204/278 X |
| 5,744,018 | 4/1998 | Santoyo et al. | 204/278 X |
| 5,837,111 | 11/1998 | Ebert | 204/278 X |

*Primary Examiner*—Donald R. Valentine
*Attorney, Agent, or Firm*—Mark E. Ogram P.C.

[57] ABSTRACT

A filtering mechanism for especially well suited for corrosive mists which are generated from electro-refining systems. A layer of bristles forming a brush is secured to an electrode within the electro-refining system. As the electro-refining system produces a mist of corrosive chemicals above the slurry, the mist rises through the bristles. As the mist passes through the bristles, the corrosive chemical adheres to the bristles; hence, the corrosive chemical does not pass into the surrounding environment. Periodically, the bristles are washed to remove the corrosive chemicals. In one embodiment of the invention, the edge between the electrodes and the wall of the slurry bath are partially sealed with a pliable member which assists in directing the mist through the bristles. In still another embodiment of the invention, the bristles are coated to react with the corrosive chemical within the bath; and in some embodiments, the coating changes colors when a selected concentration of corrosive chemical has been encountered. This changing of color assists in determining when the bristles should be cleaned of the corrosive chemical. In still another embodiment of the invention, two layers of bristles are used and a venting system is provided between the two layers of bristles.

20 Claims, 6 Drawing Sheets

EDGE BRUSH FOR ELECTRODES

This is a continuation-in-part of U.S. patent application Ser. No. 08/914,898, filed Aug. 20, 1997 now U.S. Pat. No. 5,837,111, and entitled "Corrosive Mist Scrubber", which was a continuation-in-part of U.S. Provisional Application Ser. No. 60/027,921, entitled "Corrosive Mist Scrubber" and filed Oct. 19, 1996, and U.S. Provisional Patent Application Ser. No. 60/025,590, filed Sep. 4, 1996, entitled "Insulator".

BACKGROUND OF THE INVENTION

This invention relates generally to smelting and more particularly to electrowinning tanks.

Electrowinning tanks are used for the extraction of metals from solution by using electrochemical processes. This type of process is commonly used in the extraction of copper onto plates.

In electrowinning tanks there has been a problem of acid and other chemical fumes. Excess fumes create a hazardous environment for the workers. Venting or using plastic balls, plastic pellets or chemical suppressants have not been totally successful.

Another solution to the problem is described in U.S. Pat. No. 5,470,445, entitled "Electrode Cap with Integral Tank Cover for Acid Mist Collection" issued to Murray et al. on Nov. 28, 1995. In the Murray approach, each electrode within the electrowinning process is equipped with a solid skirt-type of material which assists in forming a solid barrier above the slurry within the tank. The mist is collected between the skirt and the upper layer of the slurry. This mist is then drawn off using pumps and filters.

Unfortunately, in the field, the skirts tend to become cracked, broken, or do not seal with their neighbors. A less than adequate seal is provided allowing ambient air to be pulled through instead of the chemically laden mist.

It is clear that there is a need to be able to clean the mist produced from these tanks so that the toxic chemicals do not create environmental problems.

SUMMARY OF THE INVENTION

The invention is a filtering mechanism especially well suited for corrosive mists which are generated from electro-refining systems. While the present invention discusses the invention's attributes relative to electrowinning and electro-refining systems, the invention is not intended to be so limited. Applications for the invention are obvious to those of ordinary skill in the art.

A further attribute of the present invention is its use of improved insulators and bumpers between the electrodes used in the electrowinning process.

Within the electrowinning process, naturally occurring mists are generated above the slurry due to the operation of the electrodes within the slurry. These mists contain a number of toxic chemicals including, but not limited to, acids.

Within this invention, a layer of bristles forming a brush is secured to the electrode within the electro-refining system. The bristles extend from the edges of each electrode so that the ends of the bristles from one electrode intermingle with the ends of bristles from a neighboring electrode.

As the electro-refining system produces a mist of corrosive chemicals above the slurry, the mist rises through the bristles. The materials chosen for creation of the bristles are such that the bristles have a natural attraction for the corrosive and toxic chemicals within the mist which are to be removed.

Those of ordinary skill in the art readily recognize which materials should be used for the bristles to accomplish the task of attracting specific chemicals.

As the mist passes through the bristles, the corrosive chemicals adhere to the bristles; hence, the corrosive chemical does not pass into the surrounding environment. In this manner, the rising mist is "filtered" so that the mist which emanates from the bristles into the environment is free of the toxic chemicals.

Periodically, the bristles are washed to remove the collected corrosive chemicals. Numerous techniques are available to accomplish this task including immersion of the bristles into a cleansing bath. The preferred technique is a simple washing using a water hose arrangement with the washed away chemicals being disposed of using accepted techniques.

In one embodiment of the invention, the edges between the electrodes and the wall of the slurry bath are partially sealed with a pliable member which assists in directing the mist through the bristles. In this embodiment, the bristles extend from the sides of the electrode with the solid barrier extending from the side of the electrode. This solid barrier assists in redirecting the mist through the bristles for suitable cleaning.

In still another embodiment of the invention, the bristles are coated to react with the corrosive chemical within the bath; and in some embodiments, the coating changes colors when a selected concentration of corrosive chemical has been encountered.

As described above, one of the corrosive chemicals which is typically removed from the mist is an acid. Using a chemical well known to those of the art, a litmus type of arrangement is created on the bristles. The litmus-type of chemical is chosen to change color only when a specified level of saturation is obtained.

In this manner, the operator is able to visually scan the bristles, and, based upon their color, determine when the bristles should be cleaned. This attribute of the invention assures that the bristles are operating at their optimum.

In still another embodiment of the invention, two layers of bristles are used and a venting system is provided between the two layers of bristles. In this embodiment of the invention, a collection zone is created between the layers of bristles. Within this zone, a pipe is extended and an air-flow is created through the pipe to draw the mist from the collection zone.

This embodiment provides for a preliminary filtering by the lower layer of bristles and then an evacuation by the venting system. Any corrosive chemicals that escape from these two operations, are then removed by the filtering action of the upper layer of bristles.

Specifically, brushes are mounted on both sides of anode facing out the side. Locks hold the ends of the brushes tightly against anode while a top lock clips (or screws) hold the middle of the brush.

In one embodiment, a top clips serves the function of keeping the brushes from moving down; insulators mounted on the anode keep the brushes from moving up. These insulators also keep the anode and the cathode from touching.

End flex plastic seals are positioned between the brushes and side of tank.

In operation, the tanks are heated to over 110 degrees Fahrenheit, the rising air carries a mist. The scrubber lets the air through but collects the acid on the scrubber brushes letting less contaminated air pass through. This collection of the acid from the mist significantly reduces the clean-up required of the mist.

When the bristles need cleaning, they are washed without removal from the tanks. Using a water-hose or sprinkler system the contaminants wash from the brushes back into the acid tank.

In order to force more heated contaminated air through the brushes, the open ends, inlet and overflow, are sealed.

The preferred embodiment ideally has the following attributes:

1. Complete assembly made from acid resistant plastic;
2. The system does not trap dangerous or explosive gas by letting the tank breathe while trapping the acids on the brushes;
3. The brushes are easily cleaned with a standard water-hose or sprinkler while still working and in place;
4. The invention can be used in applications with either copper starter sheets on stainless blanks;
5. The brushes do not have to be removed when removing the anode or the cathode;
6. In tanks with starter sheets, insulators are attached under the brushes firmly secure the brushes in place;
7. When changing a tank house from starter sheets to stainless blanks, insulators are used so the anodes do not have to be modified;
8. The brushes help align the cathodes.

An aspect of the present invention is the use of an insulator which serves to electrically isolate the electrode from other electrodes, and which serves as a "bumper" to protect the electrode while the electrode is being removed and inserted into the slurry.

In this process, the present invention establishes a narrow rod which encircles the electrode and attaches to the top of the electrode via hooks or other suitable mechanism. The rod includes a series of bumps or extensions which are used to properly space the electrodes during the deposition process.

This apparatus, due to the narrow circular nature of the rod and the bumps for proper spacing, reduces any deflection growth of the copper onto the cathode blanks. Further, the apparatus of this invention provides for a strengthened deposed copper which assists in its removal so that less breakage occurs.

In the preferred embodiment, the insulator is a one piece construction and includes numerous bumps. The material used is a non-conducting material and is preferably a plastic having a diameter of approximately three-eighths of an inch. The apparatus is configured to fit over the anode which is usually three feet high.

Embodiments having from one bump or ten are contemplated depending on the actual usage.

The preferred embodiment includes a top hook hanger for safe installation of the apparatus onto the cathode blanks. Further the deflections are small to facilitate growth of the metal onto the cathode.

The invention, together with various embodiments thereof, will be more fully explained by the accompanying drawings and the following descriptions.

DRAWINGS IN BRIEF

DRAWINGS IN DETAIL

Figure 1:
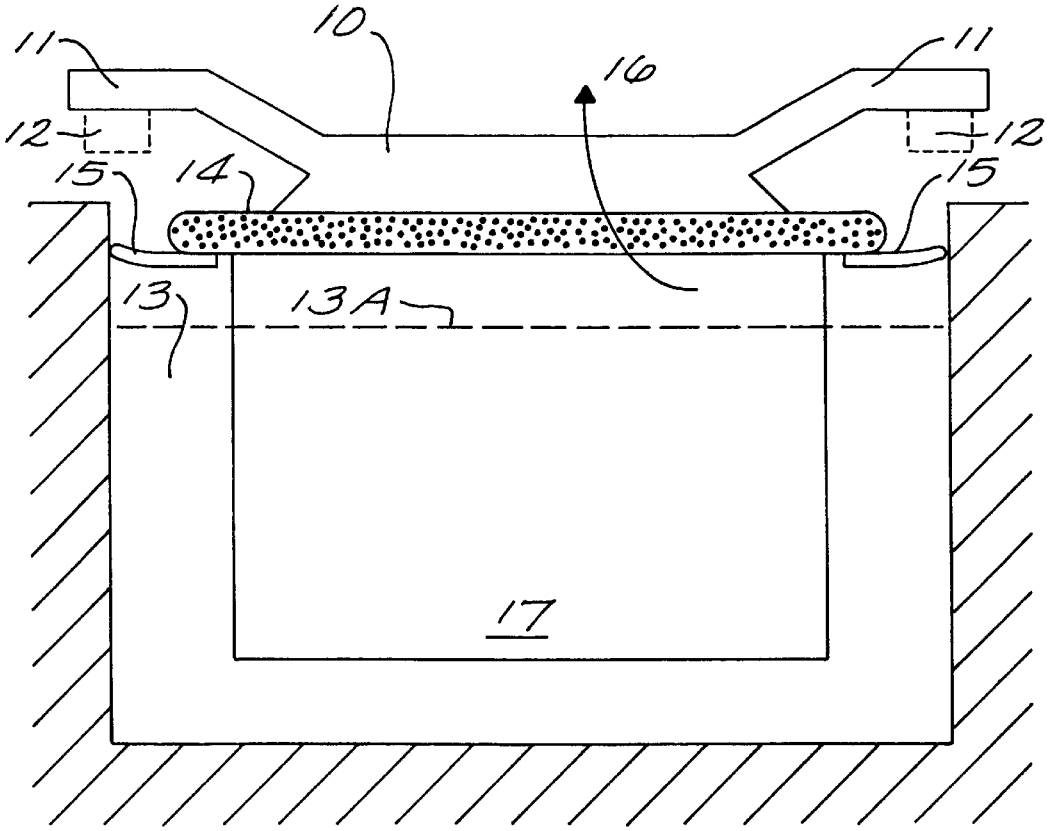
FIG. 1 is a view of an embodiment of the invention illustrating the flow of the mist through the bristles.

FIG. 1 is a side view of an embodiment of the invention illustrating the flow of the mist through the bristles.

Electrode 10 rests, via wings 11, on transmitting supports 12. Transmitting supports 12 carry an electrical charge which is communicated to plate 17 which is partially immersed in slurry 13.

As discussed earlier, a corrosive mist is created above slurry line 13A which tends to contaminate the environment. In the present invention, brush 14 contains numerous bristles which extend outward from electrode 10. Brush 14 allows gas to flow through the bristles, as illustrated by arrow 16.

During the passage of the corrosive mist through the brush 14, acids and other corrosive chemicals contained within the corrosive mist adhere to the bristles of brush 14. The bristles, in this manner, filter the corrosive chemicals from the mist so that the environment is protected.

To encourage the corrosive mist to flow through brush 14, solid flexible plates 15 extend from the ends of the brush to contact the edge of the bath. These plates 15 keep the corrosive mist from escaping around the ends of the electrodes.

Figure 2:
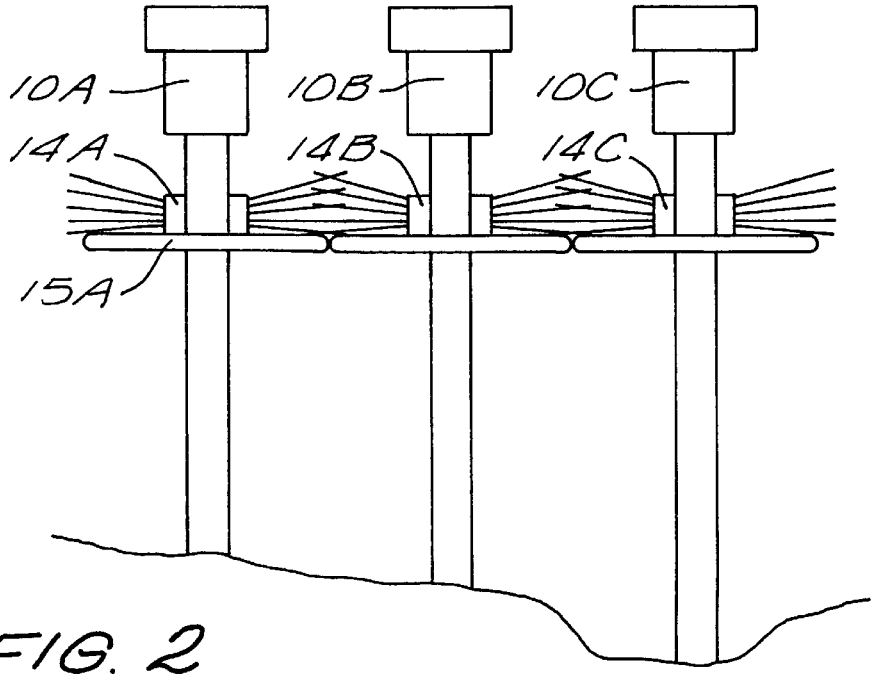
FIG. 2 is a side view of the electrodes illustrating the interlocking aspect of the bristles.

FIG. 2 is a side view of the electrodes illustrating the interlocking aspect of the bristles. In this illustration, three electrodes, 10A, 10B, and 10C, are shown, but the invention is intended to be used with any number of electrodes and in a typical electrowinning procedure, several hundred electrodes are utilized.

As discussed relative to FIG. 1, each electrode is equipped with brushes. The bristles of the brush are chosen to collect the selected chemical. The length of the bristles are such that the ends of the bristles intermix with the bristles of a neighboring electrode. As example, brush 14A has its bristles intermix with the bristles of brush 14B to form a continuous filtering barrier between electrodes 10A and 10B.

Preferably the ends of the electrodes are sealed against the edge of the bath using solid barriers such as barrier 15A.

In this manner, all of the corrosive mist which are generated by the electrowinning process, must pass through brushes 14A and 14B before being exposed to the environment. Brushes 14A and 14B, due to their natural adhesion to the corrosive chemicals within the mist, cleanse the mist of these corrosive chemicals.

Figure 3:
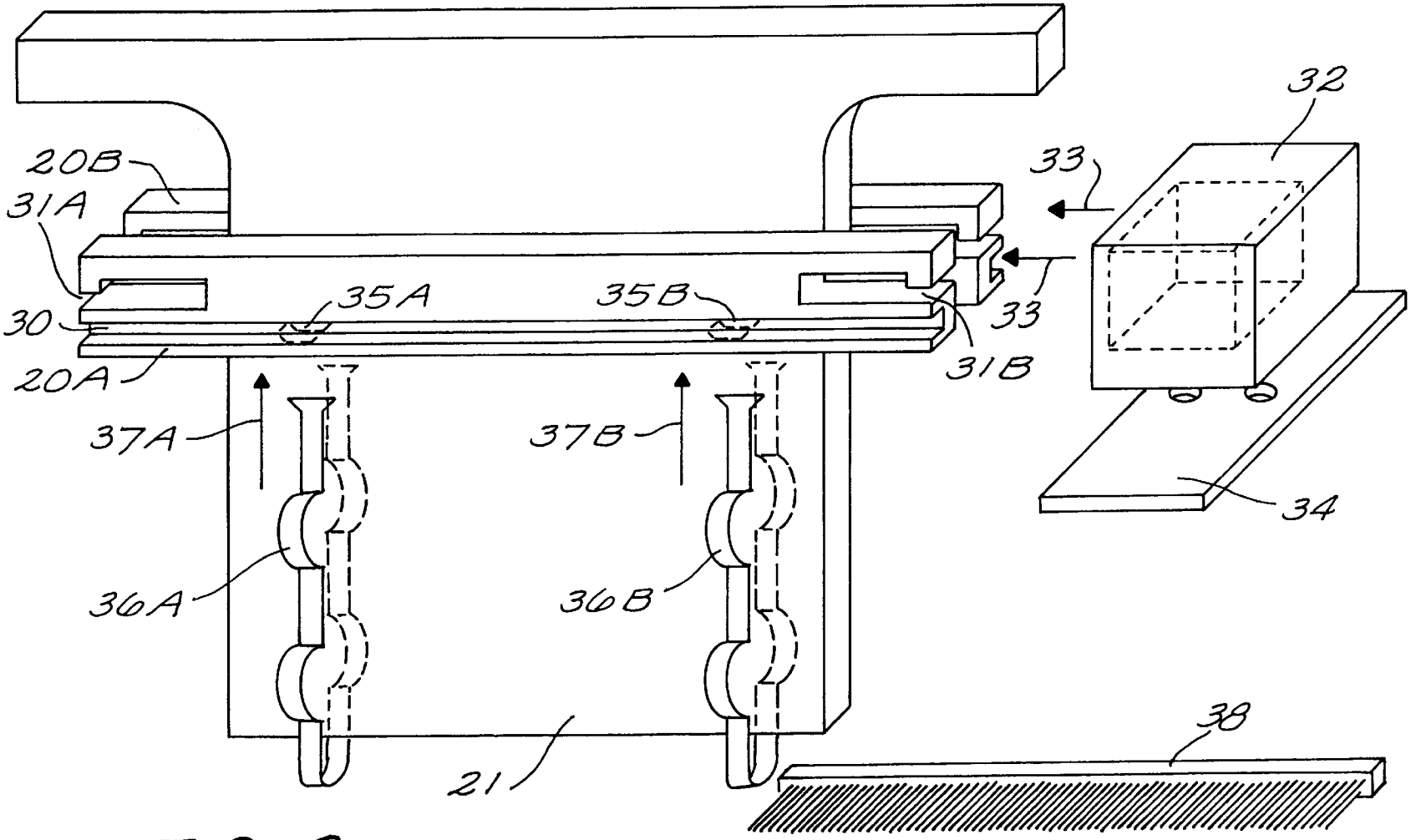
FIG. 3 is a perspective view of an embodiment of the invention.

FIG. 3 is a perspective view of an embodiment of the invention.

Electrode 21 has mounting brackets 20A and 20B positioned on each side of it. In this embodiment, each mounting bracket 20A and 20B have securing notches 31A and 31B at each end. Securing notches 31A and 31B are adapted to snap into end bracket 32 when inserted, as indicated by arrow 33. Once snapped and secured to end bracket 32 (another end bracket is secured to the opposing ends but is not shown in this illustration), mounting brackets 20A and 20B are fully secured to electrode 21.

Insulators/bumpers 36A and 36B are secured to both mounting brackets 20A and 20B via notches such as 35A and 35B. In practice, one end of insulator/bumper 36A is moved as illustrated by arrow 37A to be sandwiched between mounting bracket 20A and electrode 21; an opposing end of insulator/bumper 36A is secured in a similar manner to a notch on mounting bracket 20B. In this manner, insulator/bumper 36A passes around electrode 21 in a serpentine manner.

The ends of insulator/bumper 36A are sandwiched between the mounting brackets 20A and 20B and the electrode. This prevents the insulator/bumper 36A from being dislodged from the electrode it during normal movement of the electrode.

Insulator/bumper 36A and 36B assure that electrode 21 is not damaged while it is being lowered into the slurry, and also assure that electrode 21 is prevented from contacting a neighboring electrode.

Once mounting brackets 20A and 20B have been fully secured to electrode 21, brush 38 is slid into slot 30. Brush 38 includes bristles which are adapted to cling to corrosive chemicals within the mist generated by the action within the slurry.

To further encourage all mist to pass through the bristles of brush 38, end plate 34 is secured to end bracket 32 and is adapted to close off any other exit passages which might exist between the electrode and the edge of the slurry bath.

In this manner, an electrode is fully fitted to be insulated, protected during movement, and to stop corrosive chemicals from escaping into the environment.

Figure 4:
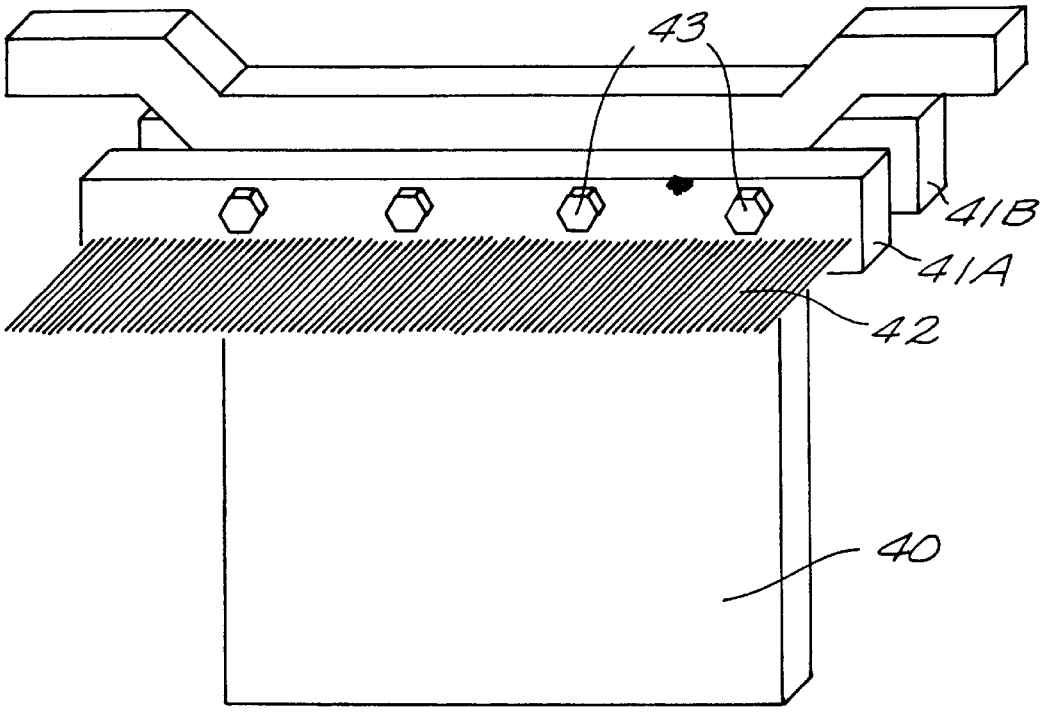
FIG. 4 is a perspective view of an alternative embodiment of the invention.

FIG. 4 is a perspective view of an alternative embodiment of the invention.

In this embodiment, bristles 42 are manufactured on mounting bracket 41A. Mounting bracket 41A is secured to electrode 40 and to mounting bracket 41B via bolts 43 which extend through holes in electrode 40.

This embodiment of the invention provides for a simple method for attaching the brush to the electrode.

Figure 5:
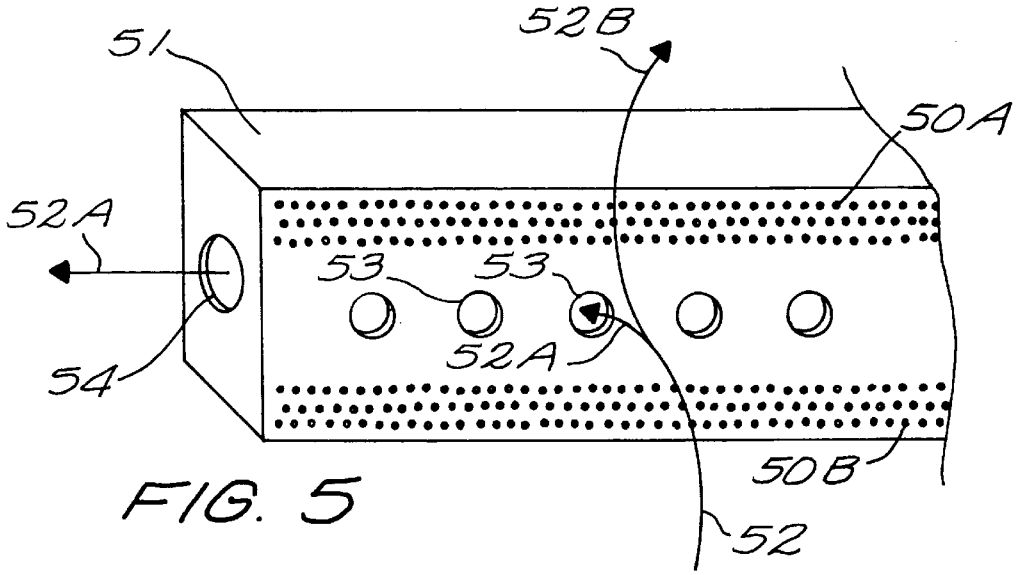
FIG. 5 illustrates an embodiment of the invention which utilizes two layers of bristles and a central evacuation chamber.

FIG. 5 illustrates an embodiment of the invention which utilizes two layers of bristles and a central evacuation chamber.

In this embodiment, two layers of bristles 50A and 50B are created on mounting bracket 51. Between layers of bristles 50A and 50B are channels 53 which extend into a central channel 54.

Rising corrosive mist, illustrated by arrow 52, pass through bristle layer 50B having some of the corrosive chemicals removed from the mist. A portion of the partially cleaned mist is withdrawn though channels 53, illustrated by arrow 52A which is then sectioned through central channel 54 to a treatment facility.

Some of the rising mist, illustrated by arrow 52B, passes through bristle layer 50A, and is further filtered before it passes into the environment.

Through selective control of the suction applied to central channel 54, the amount of mist passing through bristle layer 50A is controlled so that bristle layer 50A serves as a backup filtering should the suction fail for whatever reason.

Figure 6A:
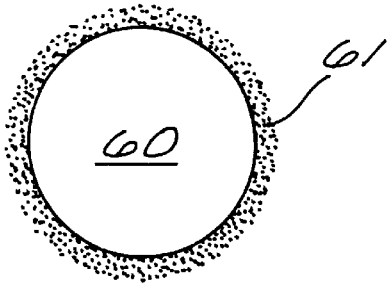
FIGS. 6A and 6B are disectional views of two embodiments of the bristles which are treated to gauge the concentration of corrosive chemicals which have been trapped.
Figure 6B:
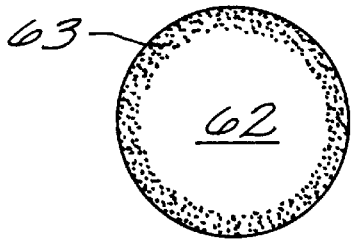

FIGS. 6A and 6B are disectional views of two embodiments of the bristles which are treated to gauge the concentration of corrosive chemicals which have been trapped.

As shown in FIG. 6A, bristle 60 has a layer of material 61 deposited onto bristle 60. Layer 61 is chosen from a variety of chemicals to give an indication of the amount of corrosive chemicals which have been adhered to the bristle during the filtering process described above. Such indicative layers are obvious to those of ordinary skill of the art and include a variety of chemicals used for standard litmus gauging of acidity.

In this manner, a visual inspection of the bristles and their color, readily identify which bristles should be cleansed through washing.

FIG. 6B illustrates the embodiment of the bristle 62 which has the same sensor chemical embedded into it as illustrated by 63. This embodiment of the bristle is preferred as the sensor chemical is not as easily dislodged from the bristle.

Figure 7A:
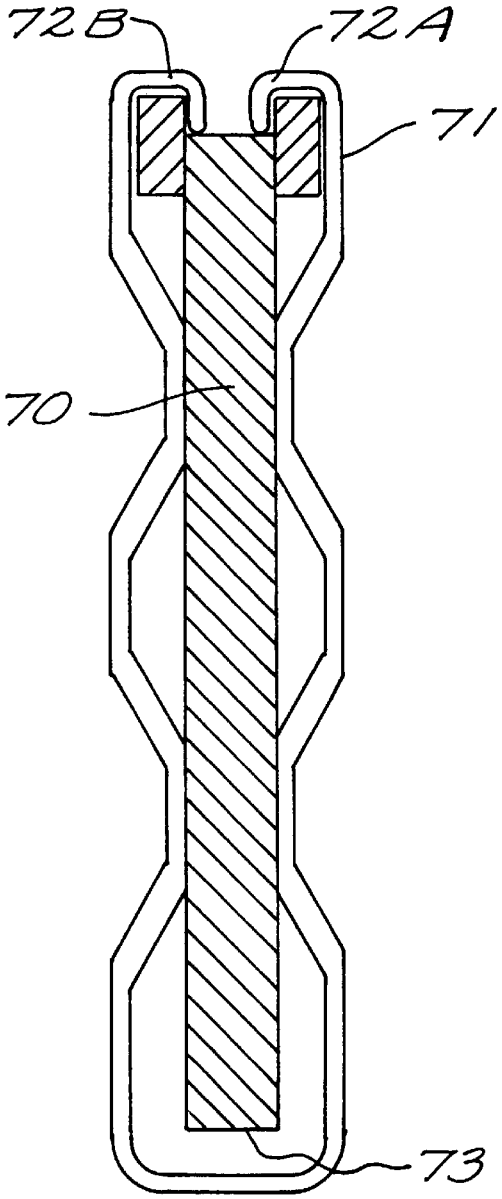
FIGS. 7A and 7B are edge and side views of an embodiment of the preferred insulator/bumper used to protect the electrodes.
Figure 7B:
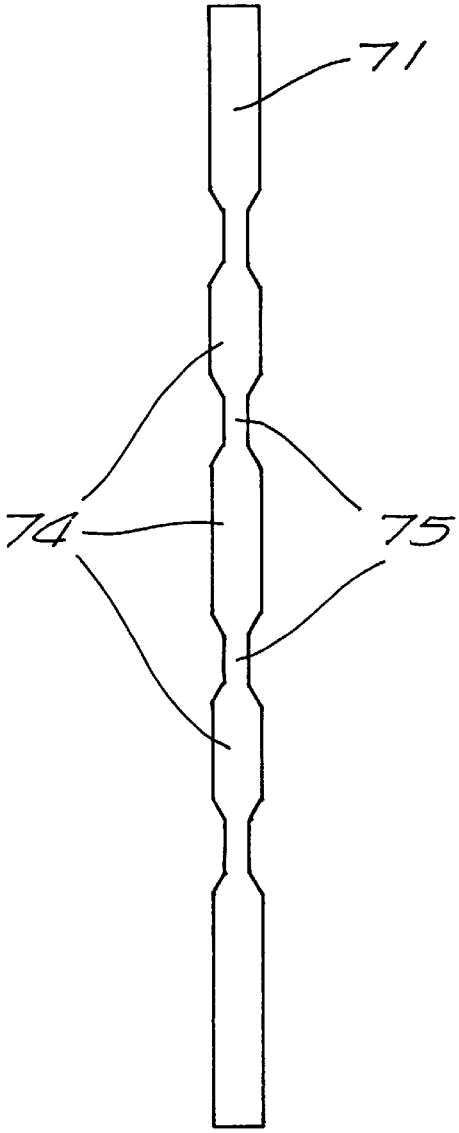

FIGS. 7A and 7B are edge and side views of an embodiment of the preferred insulator/bumper used to protect the electrodes.

The electrode insulator/bumper 71 of this invention is adapted to be mounted directly to electrode 70 using hooks 72A and 72B which are secured to the top of electrode 70. The insulator/bumper 71 extends, in a serpentine fashion, around the base 73 of electrode 70 in one continuous piece.

In the preferred embodiment, insulator/bumper 71 is manufactured from an insulating material such as polyvinylchloride which is also resistive to the corrosive nature of the slurry.

The insulator/bumper 71 of this embodiment is a generally hollow tube which has been "crushed" 74 in certain locations to provide greater rigidity and support; this crushing of the insulator/bumper 71 creates a substantially flat portion which is preferably positioned perpendicular to the plane of electrode 70. Other areas of the insulator/bumper 71 have a circular cross section 75.

The number of "bumps" and areas which are crushed are variable and are chosen during manufacture to provide the durability and protection desired for electrode 70.

Figure 8:
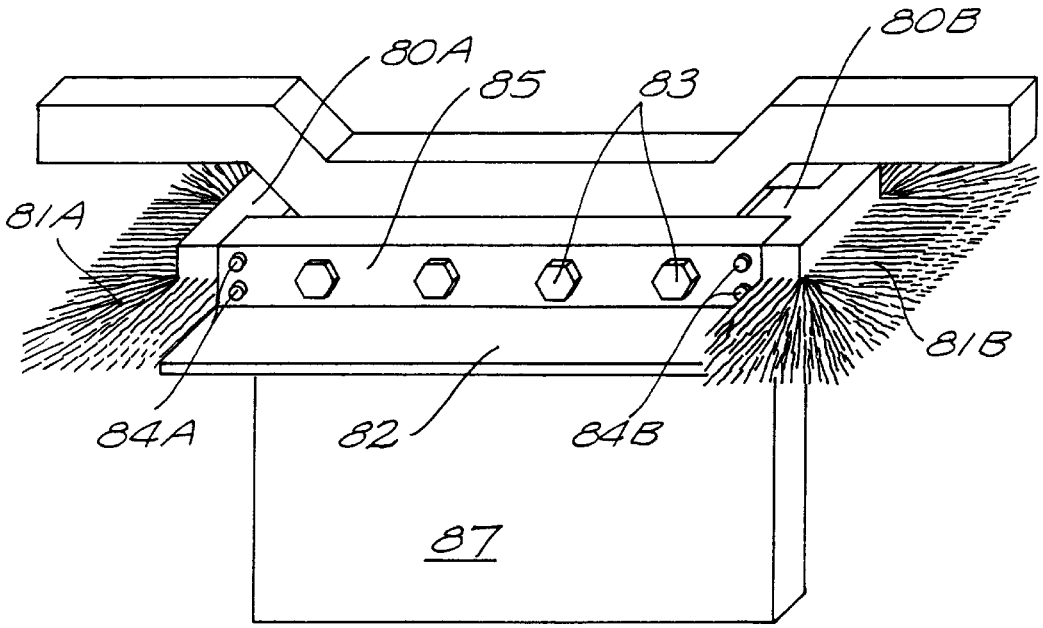
FIG. 8 is a perspective view of an alternative embodiment of the invention in which brushes extend to the walls of the slurry bath.

FIG. 8 is a perspective view of an alternative embodiment of the invention in which brushes extend to the walls of the slurry bath.

In this embodiment, a flexible panel 82 is attached to electrode 87 using frame 85 and bolts 83. A similar flexible panel extends from the opposing face of electrode 87.

Flexible panel 82 is designed to seal with another flexible panel (not shown) extending from the neighboring electrode.

Venting in this embodiment is accomplished by end-brushes 81A and 81B which are secured to electrode 87 using brackets 80A and 80B respectively. Securing pins 84A and 84B hold brackets 80A and 80B to frame 85.

The bristles on end-brushes 81A and 81B have sufficient length to contact a proximate wall in the slurry bath.

In this manner, a ring of protection (flexible panel 82, the opposing flexible panel not visible in this view, end-brush 81A and end brush 81B) is provided for the electrode.

Figure 9:
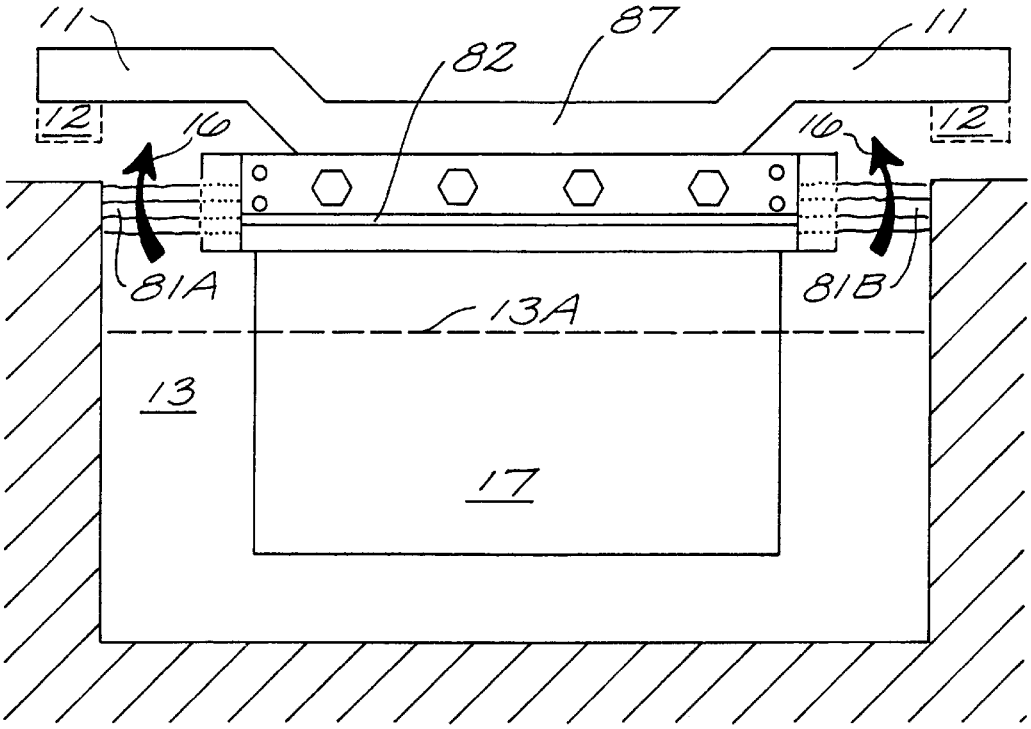
FIG. 9 illustrates the placement of the electrode of FIG. 8 into a slurry.

FIG. 9 illustrates the placement of the electrode of FIG. 8 into a slurry.

Electrode 87 rests, via wings 11, on transmitting supports 12. Transmitting supports 12 carry an electrical charge which is communicated to plate 17 which is partially immersed in slurry 13.

A corrosive mist is created above slurry line 13A which tends to contaminate the environment. In the present invention, flexible panel 82 extends outward from electrode 87 and seals with a neighboring electrode.

End brushes 81A and 81B allows gas to flow through their bristles, as illustrated by arrow 16.

During the passage of the corrosive mist through the end brushes 81A and 81B, acids and other corrosive chemicals contained within the corrosive mist adhere to the bristles of end brushes 81A and 81B. The bristles, in this manner, filter the corrosive chemicals from the mist so that the environment is protected.

Figure 10:
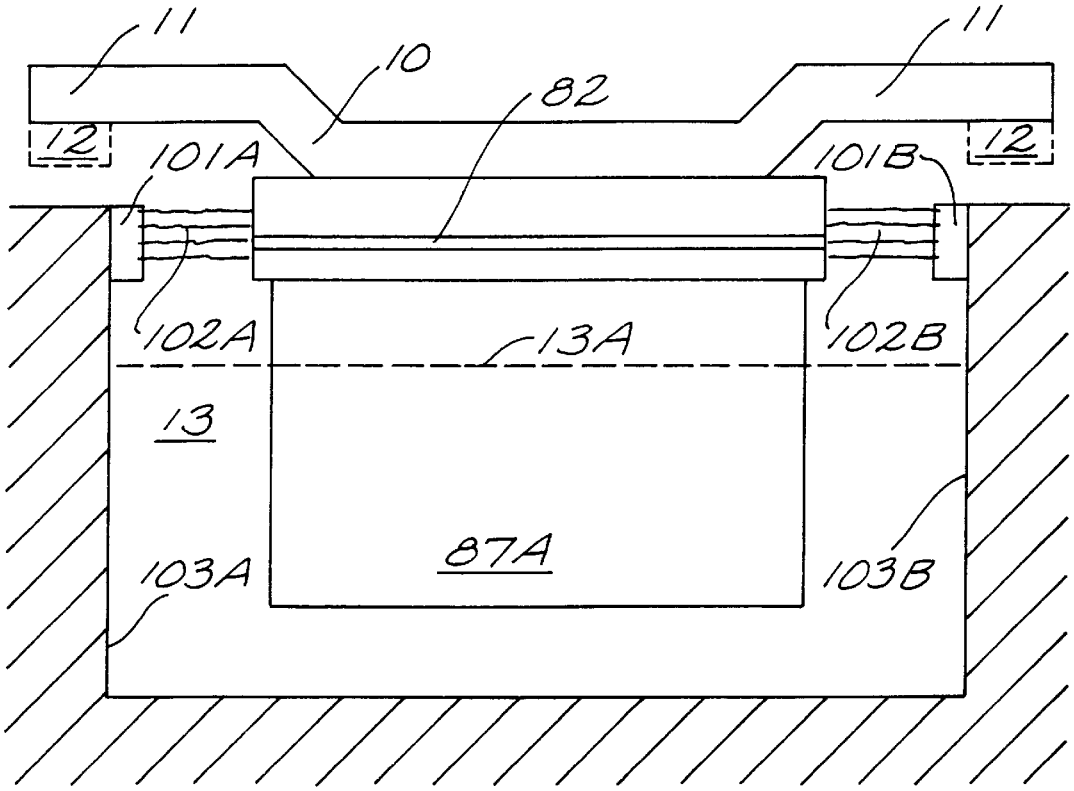
FIG. 10 illustrates an embodiment of the invention in which the end-brushes extend from the wall of the slurry.

FIG. 10 illustrates an embodiment of the invention in which the end-brushes extend from the wall of the slurry.

In this embodiment, the end brushes 102A and 102B extend along the length of slurry walls 103A and 103B respectively. End brushes 102A and 102B are secured to the slurry walls using brackets 101A and 101B respectively.

The bristles on brushes 102A and 102B have sufficient length to engage flexible panel 82 to form the "seal" sought by the invention. As before, the bristles of brushes 102A and 102B permit the vapor to rise through them so that the chemically laden air if cleansed.

It is clear that the present invention creates a highly improved electro-refining system.

What is claimed is:

1. A mist barrier comprising:

a) a first and second mounting mechanisms adapted to be secured to opposing ends of an electrode;

b) a first brush member having a multitude of bristles secured to said first mounting mechanism, said bristles of said first brush member having sufficient length to contact a refining bath wall proximate to said electrode; and, c) a second brush member having a multitude of bristles secured to said second mounting mechanism, said bristles of said second brush member having sufficient length to contact a refining bath wall proximate to said electrode.

2. The mist barrier according to claim 1, wherein said bristles include a material adapted to adhere corrosive chemicals thereto.

3. The mist barrier according to claim 2, wherein said bristles are adapted to permit airflow therebetween.

4. The corrosive mist barrier according to claim 3, wherein said first brush member is removable from said first mounting mechanism and said second brush member is removable from said second mounting mechanism.

5. The mist barrier according to claim 3, further including a reactant coating adapted to react with said corrosive chemicals, said reactant coating secured to said bristles.

6. The mist barrier according to claim 5, wherein said reactant coating is adapted to change color when exposed to a selected concentration of said corrosive chemicals.

7. An electro-refining system comprising:

a) a bath having wall members and adapted to contain a slurry of targeted chemicals;

b) an electrical source providing electrical energy; and, c) a multitude of electrodes receiving electrical energy from said electrical source and adapted to be partially immersed within said slurry, each of said electrodes having, 1) a solid metal core adapted to be hung in said slurry, 2) a mounting mechanism adapted to be secured to said solid metal core above a line created by said slurry when slurry is present, 3) a first brush member secured to said mounting mechanism, bristles of said first brush member having sufficient length to contact a first wall member of said bath proximate to said solid metal core.

8. The electro-refining system according to claim 7, further including a second brush member secured to said mounting mechanism, bristles of said second brush member having sufficient length to contact a second wall member of said bath proximate to said solid metal core.

9. The electro-refining system according to claim 8, wherein said first wall member and said second wall member are substantially parallel.

10. The electro-refining system according to claim 7, wherein said bristles of said first brush member include a material adapted to adhere a corrosive chemical thereto.

11. The electro-refining system according to claim 10, wherein said bristles of said first brush member are adapted to permit airflow therebetween.

12. The electro-refining system according to claim 11, wherein each of said bristles of said first brush member further includes a reactant adapted to react with the corrosive chemical, said coating adapted to change colors when exposed to a selected concentration of the corrosive chemical.

13. A barrier for an electrode comprising:

a) a first brush member having a multitude of bristles, said bristles of said first brush member having sufficient length to extend between a refining bath wall and an electrode; and, b) a second brush member having a multitude of bristles, said bristles of said second brush member having sufficient length to extend between a refining bath wall and an electrode.

14. The barrier for an electrode according to claim 13, wherein said first brush member and said second brush member are secured to said electrode.

15. The barrier for an electrode according to claim 13, wherein said first brush member and said second brush member are secured to the refining bath wall.

16. The barrier according to claim 13, wherein said bristles of said first brush and of said second brush include a material adapted to adhere corrosive chemicals thereto.

17. The barrier according to claim 16, wherein said bristles of said first brush and of said second brush are adapted to permit airflow therebetween.

18. The barrier according to claim 17, wherein said first brush member is removable from said electrode and said second brush member is removable from said electrode.

19. The barrier according to claim 17, further including a reactant coating adapted to react with said corrosive chemicals, said reactant coating secured to said bristles of said first brush and to said bristles of said second brush.

20. The barrier according to claim 19, wherein said reactant coating is adapted to change color when exposed to a selected concentration of said corrosive chemicals.

* * * * *